US006145168A

United States Patent [19]

Baggio et al.

[11] Patent Number: 6,145,168

[45] Date of Patent: Nov. 14, 2000

[54] LEVER PARTICULARLY FOR SPORTS SHOES

[75] Inventors: Giorgio Baggio, San Martino di Lupari; Luca Marconato, Sala di Istrana; Dino Giusti, Godega Sant'Urbano, all of Italy

[73] Assignee: HTM Sport SpA, Italy

[21] Appl. No.: 09/273,992

[22] Filed: Mar. 22, 1999

[30] Foreign Application Priority Data

Mar. 27, 1998 [IT] Italy ..... MI98A0646

[51] Int. Cl.[7] ..... A43C 11/25; A44B 21/00

[52] U.S. Cl. ..... 24/70 SK; 24/68 SK; 24/71 SK

[58] Field of Search ..... 24/70 SK, 71 SK, 24/68 SK

[56] References Cited

U.S. PATENT DOCUMENTS

| | | | |
|---|---|---|---|
| 2,704,071 | 3/1955 | Becker | 24/300 |
| 3,182,366 | 5/1965 | Teufel | 24/68 SK |
| 3,662,435 | 5/1972 | Allsop | 24/70 SK |
| 4,424,636 | 1/1984 | Everest | 24/68 SK |
| 4,587,870 | 5/1986 | Colburn | 24/70 SK |
| 4,651,392 | 3/1987 | Olivieri . | |
| 4,664,406 | 5/1987 | Spitaler et al. | 280/632 |
| 5,530,997 | 7/1996 | Tessari | 24/71 SK |
| 5,669,122 | 9/1997 | Benoit | 24/70 SK |
| 5,715,582 | 2/1998 | Zorzi | 24/71 SK |

FOREIGN PATENT DOCUMENTS

| | | | |
|---|---|---|---|
| 0 300 955 | 1/1989 | European Pat. Off. . | |
| 0 787 443 A1 | 1/1997 | European Pat. Off. . | |
| 2700795 | 7/1978 | Germany | 24/70 SK |
| 29 12 946 | 10/1980 | Germany . | |

*Primary Examiner*—Victor N. Sakran
*Attorney, Agent, or Firm*—R. Neil Sudol; Henry D. Coleman

[57] ABSTRACT

A lever which is used in particular in the field of sports shoes and includes a lever arm 5 which is rotatably associated, at one end, with a support 3 which is rigidly coupled to a flap of the shoe. An auxiliary grip lever 11 for the user is associated with the lever arm at the free end and allows to increase the working length of the lever arm, thus ensuring easier closure thereof.

10 Claims, 6 Drawing Sheets

LEVER PARTICULARLY FOR SPORTS SHOES

BACKGROUND OF THE INVENTION

1. Field of the Invention

The present invention relates to a fastening lever for sports shoes.

2. Description of the Prior Art

Several types of lever are currently known which have the main function of allowing to fasten two flaps of a shoe, such as for example a ski boot, a roller skate or ice skate, or a mountain boot.

Levers are known which include a support constituted by a plate rigidly coupled at a flap of the shoe from which two wings protrude laterally. The end of a lever arm is pivoted to the ends of the wings, and a connecting member for a metal wire or string is pivoted to the lever arm approximately in a middle region. The metal wire or string is connected to a tooth and the tooth or metal wire interacts with, or selected engages at, one of a plurality of teeth which protrude from a rack which is rigidly coupled to the other flap to be joined.

In these conventional types of lever, the user closes the boot by presetting the mutual connection between the rack and the metal wire or tooth and by then rotating the lever arm by gripping its free end.

Such closure operation is awkward, because the user must exert a considerable effort because the flaps to be joined can be constituted by plastic flaps which are stiff and between which a certain friction is produced, because when fastening the flaps it is necessary to compress an innerboot which surrounds the leg or foot of the user, and because the length of the lever arm is short with respect to the pivoting point of the connecting member.

All this is worsened by the fact that the user usually wears gloves and therefore is unable to achieve a good hold on the lever arm.

If instead the user were to perform closure without wearing gloves, he would be certainly hindered in this maneuver, because the lever, if made of metal, would be difficult to grip at the low temperatures at which the shoe is used, and by having a limited grip surface might escape from the grip of the user, who might even injure himself.

Finally, it is noted that the lever arm, if it has to fasten the quarter of a boot or skate, is usually arranged laterally to the leg and therefore forces the user to perform an additional effort with respect to the force that might be performed to close the lever for example in the toe region.

SUMMARY OF THE INVENTION

The aim of the present invention is therefore to overcome the above described drawbacks and therefore solve the described technical problems by providing a lever which allows the user to fasten it easily and quickly.

An object is to provide a lever which can be fastened by the user by applying a low force and while having an optimum grip thereon during closure.

A further object is to provide a lever which is structurally simple and has low manufacturing costs.

A further object is to provide a lever which allows optimum fastening of the flaps of a shoe.

This aim, these objects and others which will become apparent from the following description are achieved by a fastening lever for sports shoes, comprising a lever arm which is rotatably associated, at a first end, with a support which is rigidly coupled to a flap of the shoe, characterized in that an auxiliary grip lever for the user, adapted to temporarily increase the working length of the lever arm, is associated with the lever arm.

BRIEF DESCRIPTION OF THE DRAWINGS

Other objects will become apparent from the following description, which must be considered together with the accompanying drawings, which illustrate by way of non-limitative example two particular embodiments, wherein.

DETAILED DESCRIPTION OF PREFERRED EMBODIMENT OF THE INVENTION

Figure 1:
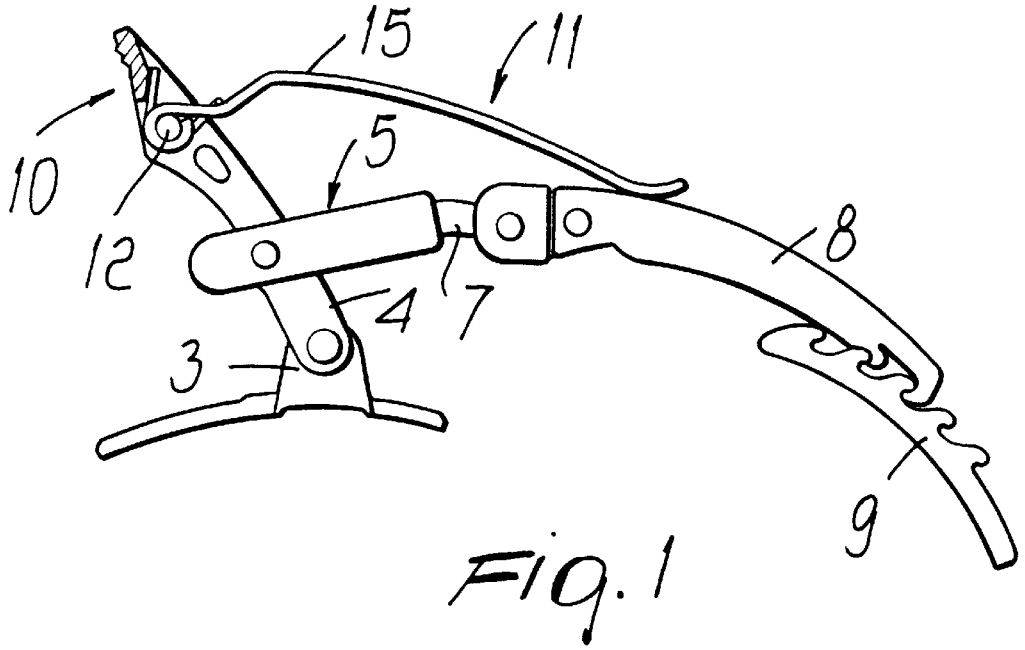
FIG. 1 is a side view of the lever in the condition that precedes the fastening step.
Figure 2:
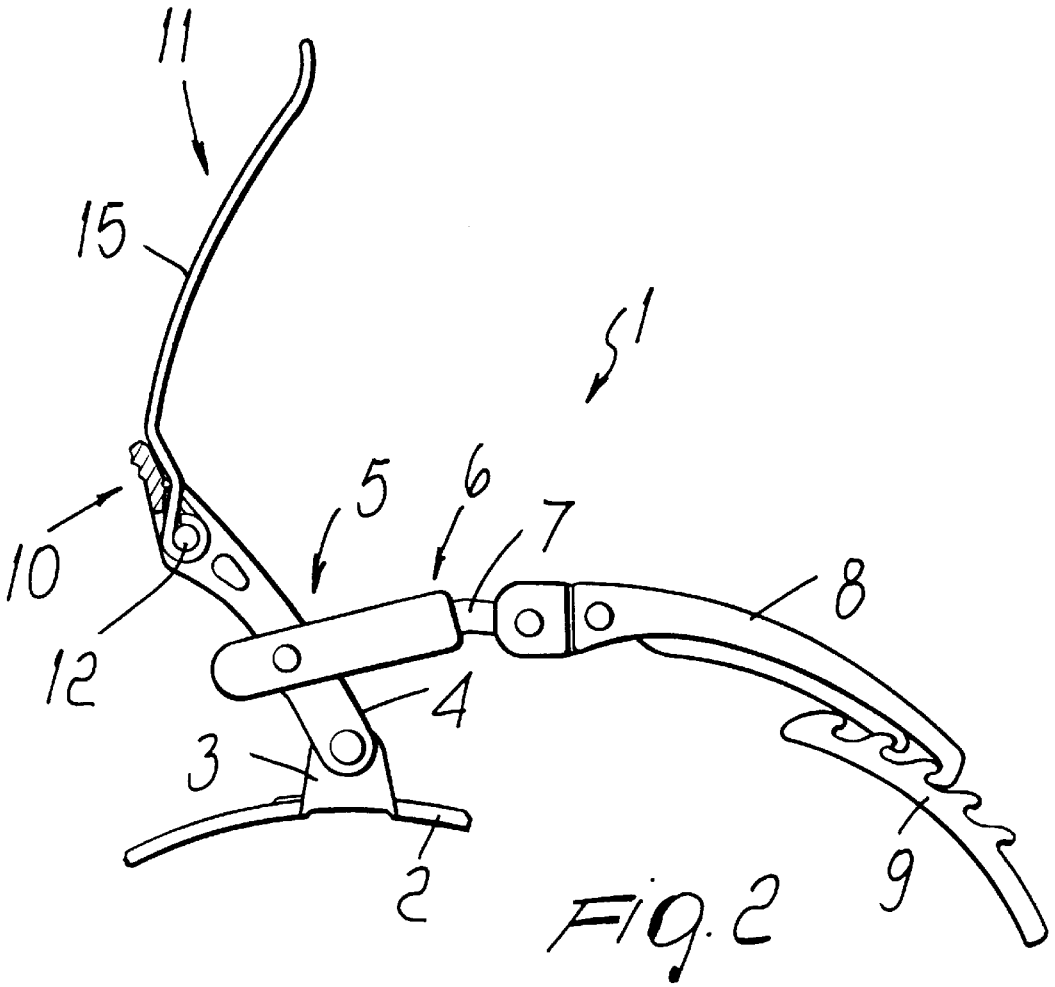
FIG. 2 is a side view of the lever in the condition which allows to fasten it.
Figure 3:
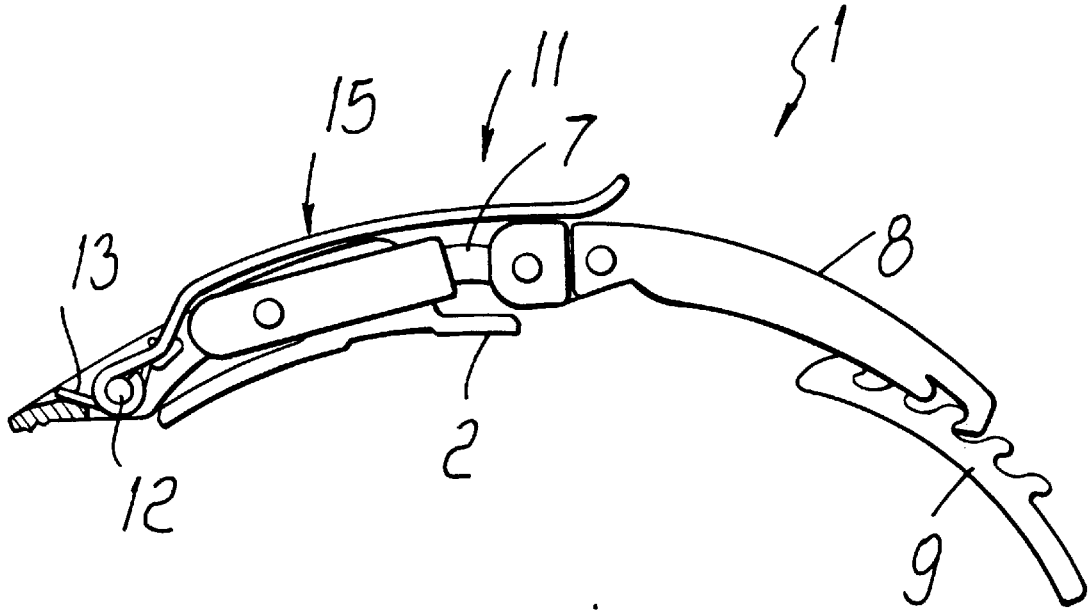
FIG. 3 is a side view of the lever after fastening has been completed.
Figure 4:
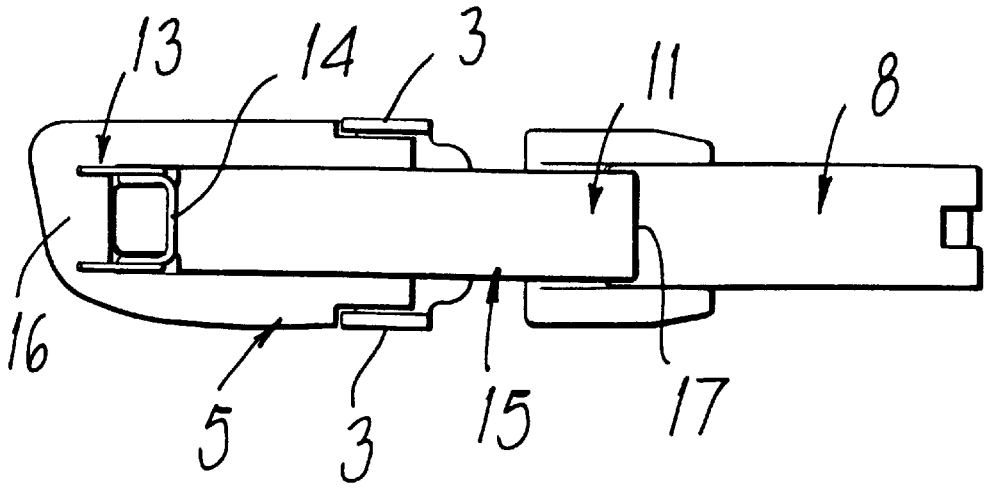
FIG. 4 is a top view of the lever.

With reference to the above figures, and bearing in mind that they exemplify particular embodiments, that they are in different scales and that individual reference numberals designate identical or equivalent elements in the figures, the reference numeral 1 designates a lever which is particularly useful in the field of sport shoes such as for example ski boots, roller skates, ice skates and mountain boots.

The lever is constituted by a plate 2 which can be rigidly coupled to a first flap of the shoe and from which two wings 3 protrude laterally; a first end 4 of a lever arm 5 is pivoted to the wings, and a connecting member 6 is rotatably associated for example with the lever arm and provides connection to an elongated member such as a metal wire or cable 7 which is in turn connected to a tooth 8 which selectively interacts at a rack 9 associated with a second flap to be joined of the shoe.

The structure of these components is illustrated by way of example in order to provide a complete description of operation.

According to the invention, an auxiliary grip lever 11 for the user is for example associated proximate to the second free end 10 at the lever arm 5.

The auxiliary lever 11 is, for example, rotatably pivoted at one end at a pivot 12 which connects the wings of the lever arm 5. The rotating connection occurs in contrast with a flexible member, such as a substantially U-shaped spring 13 the base 14 of which interacts at the upper lateral surface 15 of the auxiliary lever 11 and the wings of which are coxially wound around the pivot 12 and then interact, at their ends, with the upper lateral surface 16 of the lever arm 5.

The shape of the auxiliary lever 11 and the arrangement of the spring 13 are such as to force the auxiliary lever 11 to arrange itself adjacent to the lever arm 5 so that its free end 17 is directed toward the tooth 8 and optionally lies partially above it.

The free end 17 can advantageously have an arc-like shape, so as to protrude beyond the surface of the tooth 8 and therefore allow the user a good grip. The auxiliary lever 11 is therefore allowed, by loading the spring 13, to rotate counterclockwise until it interacts by abutment with the second free end 10 of the lever arm 5. A further rotation imparted by the user to the auxiliary lever 11 produces a rotation of the lever arm 5, consequently fastening the flaps. Because of the longitudinal and/or transverse extension of the auxiliary lever 11, the fastening of the lever is considerably eased, since the user has available a lever arm which virtually has a greater working length given by the sum of the lever arm 5 and approximately of the auxiliary lever 11 that protrudes axially from it.

The illustrated embodiment therefore has achieved the intended aim and all the intended objects, since a lever has been obtained which allows the user to achieve much more easily and quickly, and with less effort, the fastening of the flaps and therefore the closure of the lever, this operation being possible with a better grip and safely.

The presence of the spring that repositions the auxiliary lever 11 adjacent to the lever arm 5 allows to leave the space occupation of the lever substantially unchanged, without therefore altering the aesthetics of the shoe.

The illustrated embodiment can be the subject of numerous variations, within the scope of the claims.

Figure 5:
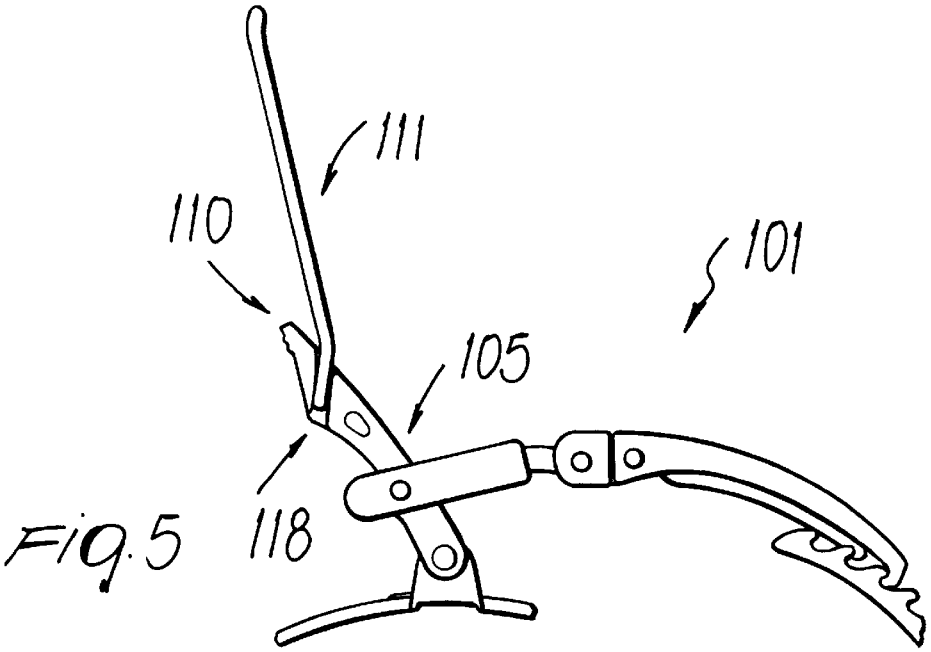
FIG. 5 is a view, similar to FIG. 2, of another embodiment.
Figure 6:
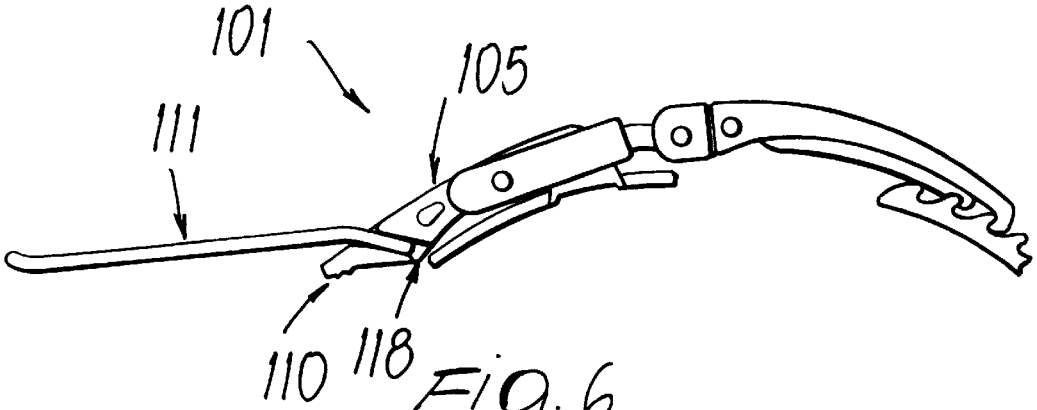
FIG. 6 is a view of the lever of FIG. 5 in the condition in which the lever is fastened.
Figure 7:
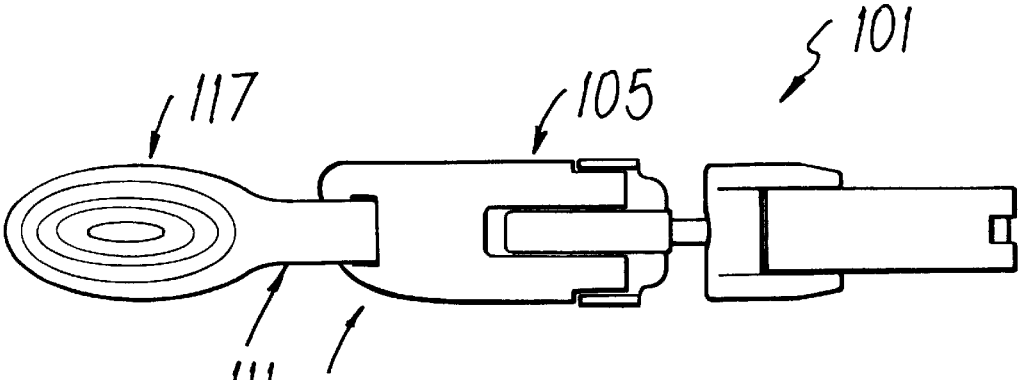
FIG. 7 is a top view of the lever of FIG. 6.

Thus, for example, FIGS. 5, 6 and 7 illustrate another embodiment for a lever 101 in which at the second free end 110 of the lever arm 105 there is a seat 118 which is preferably a through seat and has a given inclination with respect to the upper lateral surface 116 of the lever arm.

The end of a separate auxiliary lever 111 can be arranged within the seat 118 and by being appropriately shaped can protrude beyond the lever arm 105 so as to temporarily increase the working length thereof, accordingly making it easier for the user to fasten the lever.

The auxiliary lever 111 can therefore be temporarily associated at the lever arm 105 and can be stored in the user's pocket after fastening has been achieved. In this case the auxiliary lever 111 can therefore have a free end 117 which is shaped appropriately and is therefore for example wider than the end that can be positioned at the seat 118, so as to further increase grip for the user as well as force distribution.

Figure 8:
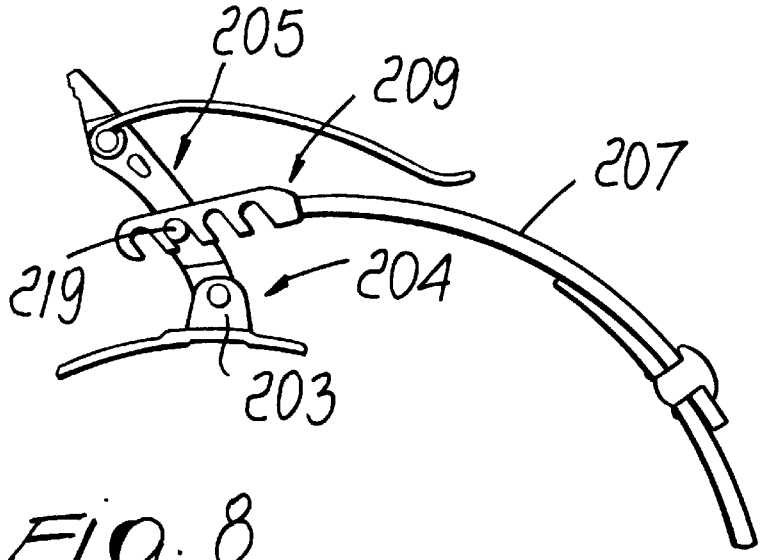
FIG. 8 is a view, similar to FIG. 2, of another embodiment of the lever.
Figure 9:
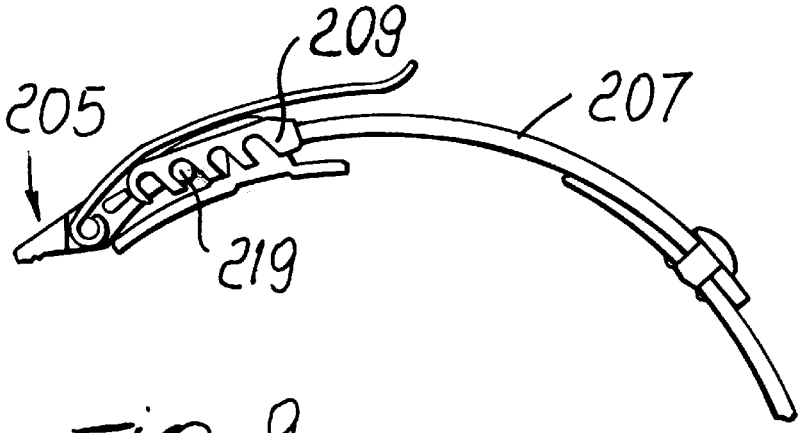
FIG. 9 is a view, similar to FIG. 3, of the embodiment of FIG. 8.
Figure 10:
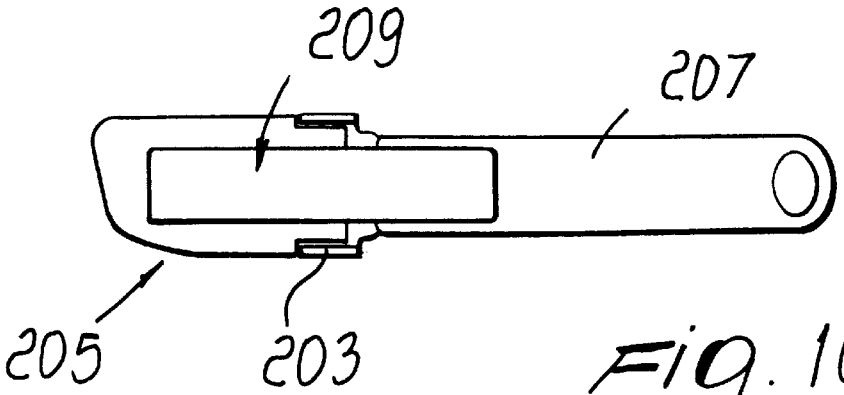
FIG. 10 is a top view of the embodiment of FIG. 9.

Therefore, also this embodiment has achieved the intended aim and objects. FIGS. 8 to 10 show another embodiment, in which the lever is constituted by a plate which can be rigidly coupled to a first flap of the shoe and from which two wings 203 protrude laterally; a first end 204 of a U-shaped lever arm 205 is pivoted to the wings, and at least one transverse pivot 219 is arranged between the wings; a rack 209 is detachably associable with the transverse pivot and is connected to an elongated member such as a band 207 which is in turn connected to a second shoe flap to be joined.

Figure 11:
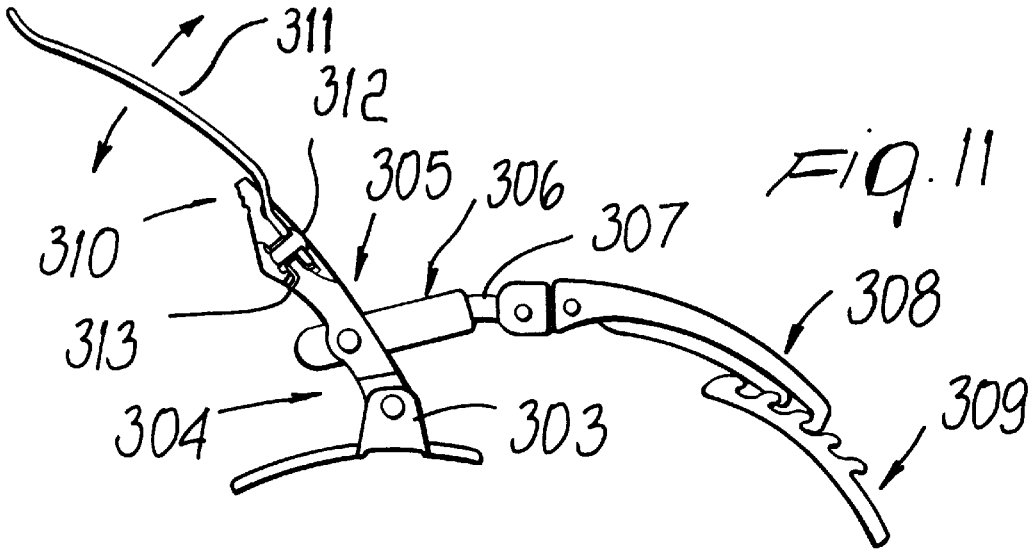
FIGS. 11, 12 and 13 are views, similar to FIGS. 8, 9 and 10, of another embodiment of the lever.
Figure 12:
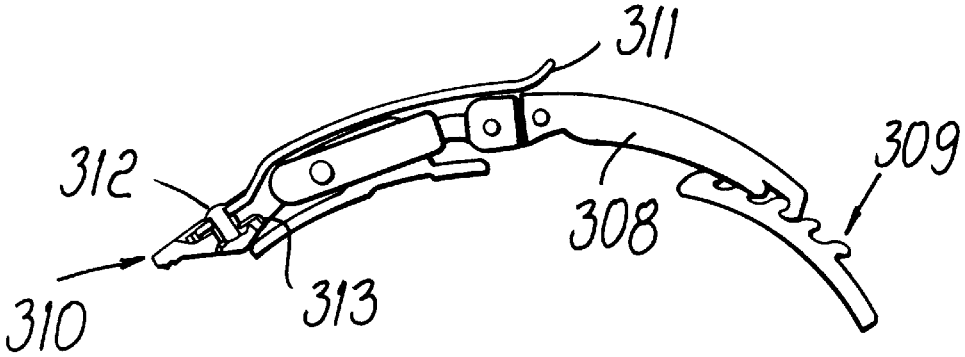
Figure 13:
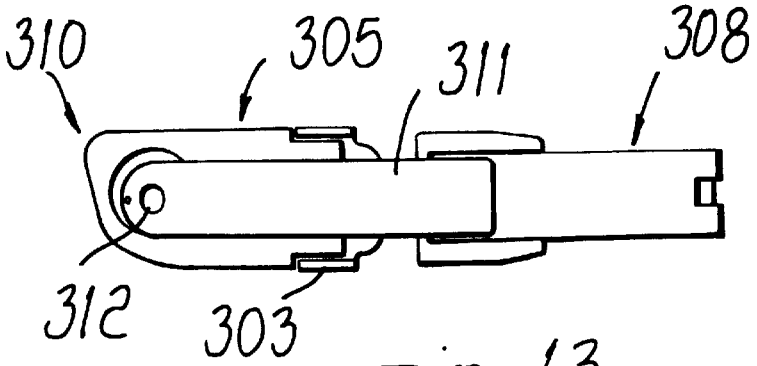

FIGS. 11 to 13 show another embodiment, in which the lever is constituted by a plate which can be rigidly coupled to a first flap of the shoe and from which two wings 303 protrude laterally. A first end 304 of a U-shaped lever arm 305 is pivoted to the wings, and a member 306 for connection to a metal cable or string 307 is rotatably associated with the lever arm. In turn, the cable or string is connected to a tooth 308 which selectively interacts at a rack 309 which is associated with a second shoe flap to be joined.

An auxiliary grip lever 331 for the user is rotatably associated at the lever arm 305 proximate to the second free end 310.

The lever 311 is rotatably pivoted, at one end, at a pivot 312 which is arranged at right angles to the wings of the lever arm 305. Rotary connection occurs in contrast with a flexible member, such as a torsion spring 313 which is coaxial to the pivot and is locked, at its ends, to the lever arm and to the auxiliary lever, the spring allows to keep the auxiliary lever, as shown in FIG. 13, arranged axially with respect to the lever arm 305. The auxiliary lever is allowed to turn for example clockwise through approximately 180□, so that it can be used in the rotation that can be imparted to the lever arm 305.

The lateral opening of the auxiliary lever facilitates closure and opening, while the inactive position of the auxiliary lever also acts as a member for preventing the opening of the lever arm 305.

Figure 14:
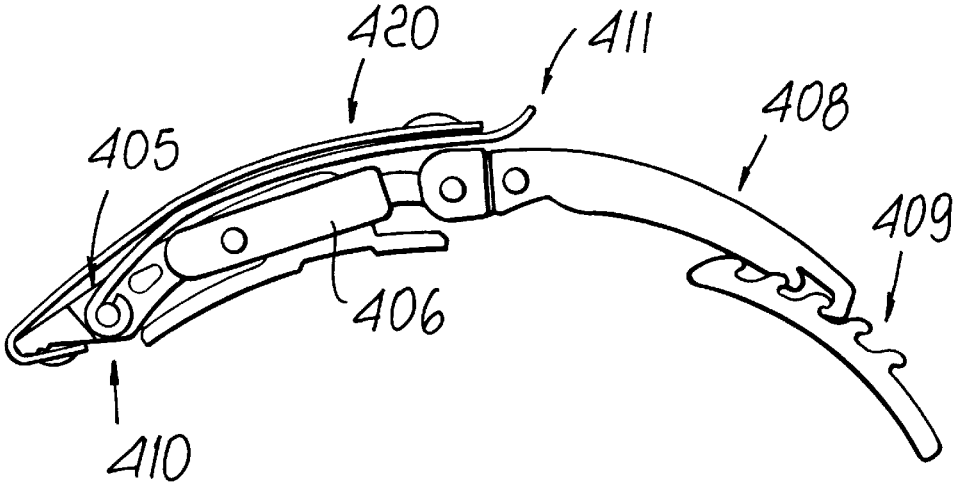
FIGS. 14 and 15 are views, similar to FIGS. 2 and 3, of another embodiment of the lever.
Figure 15:
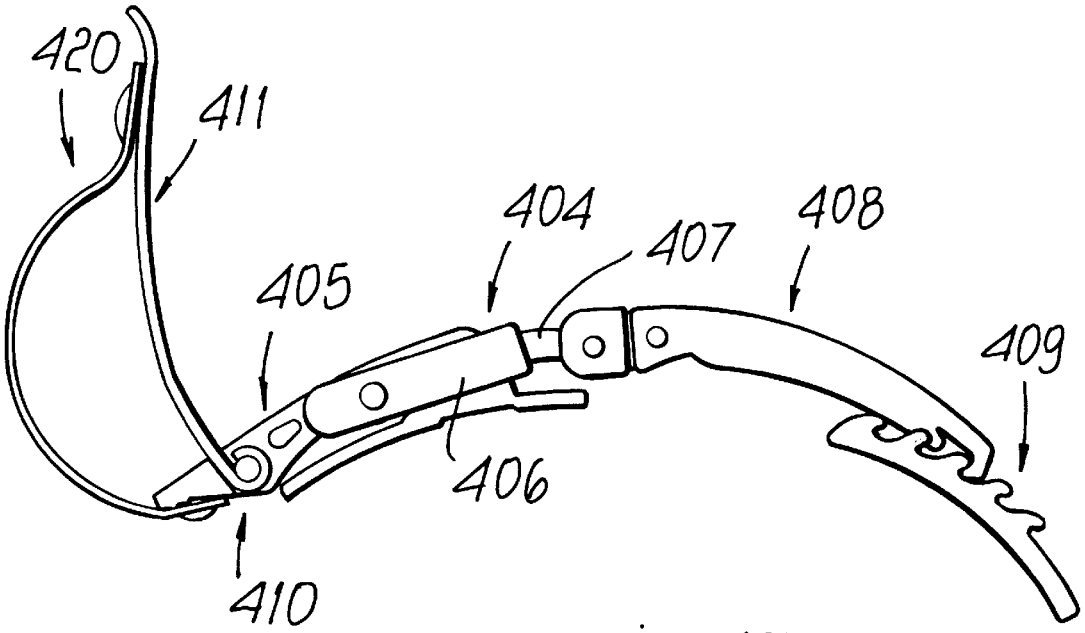

FIGS. 14 and 15 show another embodiment, in which the lever is constituted by a plate which can be rigidly coupled to a first flap of the shoe and from which two wings protrude laterally. A first end 404 of a U-shaped lever arm 405 is pivoted to the wings, and a member 406 for connection to a metal cable or string 407 is rotatably associated with the lever arm; in turn, the cable or string is connected to a tooth 408 which selectively interacts at a rack 409 which is associated with a second shoe flap to be joined.

An auxiliary grip lever 411 for the user is rotatably associated at the lever arm 405, proximate to the second free end 410.

The corresponding end of a soft grip member 420, such as a band which is associated, at its other end, for example with the free end of the lever 411, is associated with the auxiliary lever in a lower region, at the second end 410. Since the band is approximately as wide as the auxiliary lever and has a such a length that it is tensioned when the auxiliary lever is arranged adjacent to the lever arm, the band causes no hindrance during sports practice; on the contrary, it is suitable to further facilitate the user's grip as soon as the auxiliary lever is raised, since a loop is formed.

The above embodiments, too, achieve the intended aim and objects.

The materials and the dimensions that constitute the individual components of the lever may of course be the most pertinent according to the specific requirements.

What is claimed is:

1. A fastening lever assembly for sports shoes, comprising:

a support rigidly fixable to a first flap of a shoe, said support including a plate which can be rigidly coupled to said first flap and from which two wings protrude laterally;

a lever arm rotatably coupled, at a first end, to said wings of said support;

an auxiliary lever pivotably secured at a pivot to a second end of said lever arm for temporarily increasing a working length or moment arm of said lever arm, said auxiliary lever being biased by a substantially U-shaped spring to rotate in one direction about said pivot, said spring having a base or middle portion in contact with a major lateral surface of said auxiliary lever, said spring having wings or end portions wound coaxially around said pivot, said spring having free ends in contact with a major lateral surface of said lever arm; and a connecting member for connecting to an elongated member, said connecting member being rotatably linked to said lever arm at a point between said first end and said second end, said elongated member being provided with a tooth for forming a selective attachment to a rack securable to a second flap to be joined to the shoe, said auxiliary lever having a shape and said spring having a disposition so as to force said auxiliary lever to arrange itself adjacent to said lever arm with a free end of said auxiliary lever being directed toward said tooth.

2. The lever assembly according to claim 1, wherein said free end of said auxiliary lever has an arc-like shape so as to protrude beyond a surface of said tooth in order to provide a good grip for a user.

3. The lever assembly according to claim 2, wherein said lever arm is provided at said second end with an abutment for stopping said auxiliary lever upon a rotation thereof in another direction opposite said one direction and in opposition to a restoring force exerted by said spring, whereby said auxiliary lever increases said working length or moment arm of said lever arm to facilitate a fastening of said first flap and said second flap.

4. The lever assembly according to claim 1, wherein said auxiliary lever is permanently or irremovably secured to said lever arm at said second end thereof.

5. A fastening lever assembly for sports shoes, comprising:

a support rigidly couplable to a first flap of a shoe, said support including a plate rigidly couplable to said first flap of the shoe and further including two wings protruding laterally from said plate;

a lever arm rotatably connected at a first end to said support, the first end of said lever arm being pivoted to said wings;

an auxiliary lever for the user for temporarily increasing a working length or moment arm of said lever arm, said auxiliary lever being rotatably mounted to said lever arm at a pivot, said auxiliary lever being biased by a substantially U-shaped spring to rotate in one direction about said pivot, said spring having a base or middle portion in contact with a major lateral surface of said auxiliary lever, said spring having wings or end portions wound coaxially around said pivot, said spring having free ends in contact with a major lateral surface of said lever arm;

a connecting member for connecting to an elongated member, said connecting member being rotatably linked to said lever arm at a point between said first end and said second end, said elongated member being provided with a tooth for forming a selective attachment to a rack securable to a second flap to be joined to the shoe, said auxiliary lever having a shape and said spring having a disposition so as to force said auxiliary lever to arrange itself adjacent to said lever arm with a free end of said auxiliary lever being directed toward said tooth.

6. The lever assembly according to claim 5, wherein said free end of said auxiliary lever has an arc-like shape so as to protrude beyond a surface of said tooth in order to provide a good grip for a user.

7. The lever assembly according to claim 6, wherein said lever arm is provided at said second end with an abutment for stopping said auxiliary lever upon a rotation thereof in another direction opposite said one direction and in opposition to a restoring force exerted by said spring, whereby said auxiliary lever increases said working length or moment arm of said lever arm to facilitate a fastening of said first flap and said second flap.

8. The lever assembly according to claim 5, wherein said auxiliary lever is rotatably mounted at one end to said lever arm at a pivot oriented at substantially right angles to said wings of said support, further comprising a flexible torsion spring coaxial with said pivot and locked at opposite ends to said lever arm and said auxiliary lever, said torsion spring exerting a restoring force to bias said auxiliary lever into an inactive position substantially parallel to said lever arm.

9. A fastening lever assembly for sports shoes, comprising:

a support rigidly fixable to a first flap of a shoe, said support including a plate which can be rigidly coupled to said first flap and from which two wings protrude laterally;

a lever arm rotatably coupled, at a first end, to said wings of said support;

an auxiliary lever pivotably secured to a second end of said lever arm for temporarily increasing a working length or moment arm of said lever arm, said auxiliary lever being rotatably mounted at one end to said lever arm at a pivot oriented at substantially right angles to said wings of said support;

a connecting member for connecting to an elongated member, said connecting member being rotatably linked to said lever arm at a point between said first end and said second end, said elongated member being provided with a tooth for forming a selective attachment to a rack securable to a second flap to be joined to the shoe; and a flexible torsion spring coaxial with said pivot and locked at opposite ends to said lever arm and said auxiliary lever, said torsion spring exerting a restoring force to bias said auxiliary lever into an inactive position substantially parallel to said lever arm.

10. The lever assembly according to claim 9, wherein said auxiliary lever is rotatable through approximately 180° in opposition to said restoring force, said auxiliary lever being utilizable in a rotated position to increase said working length or moment arm of said lever arm, in the subsequent rotation that can be imparted to said lever arm, said auxiliary arm acting in said inactive position as a member for preventing an opening of said lever arm.

* * * * *